US007404738B2

(12) United States Patent
Montena

(10) Patent No.: US 7,404,738 B2
(45) **Date of Patent: *Jul. 29, 2008**

(54) RF SIGNAL SPLITTER WITH INTEGRATED CONNECTORS

(75) Inventor: Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/770,883

(22) Filed: Jun. 29, 2007

(65) Prior Publication Data

US 2008/0014790 A1 Jan. 17, 2008

Related U.S. Application Data

(63) Continuation-in-part of application No. 11/563,421, filed on Nov. 27, 2006, now Pat. No. 7,347,728, which is a continuation of application No. 11/074,098, filed on Mar. 7, 2005, now Pat. No. 7,153,160.

(51) Int. Cl.
*H01R 9/05* (2006.01)

(52) U.S. Cl. ..... 439/579; 439/536; 439/675

(58) Field of Classification Search ..... 439/578, 439/579, 536, 535, 675
See application file for complete search history.

(56) References Cited

U.S. PATENT DOCUMENTS 4,025,150 A 5/1977 Nordberg et al.
4,226,495 A 10/1980 Palle et al.
5,136,411 A 8/1992 Paik et al.
5,677,578 A 10/1997 Tang
5,735,711 A 4/1998 Fremgen
5,833,481 A 11/1998 Inoue
5,939,672 A 8/1999 Tang
6,018,278 A 1/2000 Tang
6,069,315 A 5/2000 Tang
6,309,251 B1 10/2001 Tang
6,648,683 B2 11/2003 Youtsey
6,768,055 B1 7/2004 Gorin
7,153,160 B2 * 12/2006 Montena ..... 439/579

* cited by examiner

*Primary Examiner*—Tho D Ta
(74) *Attorney, Agent, or Firm*—Hiscock & Barclay, LLP

(57) ABSTRACT

The RF signal splitter of the present invention comprises a splitter housing and associated components for forming an integrated F-Type connector. The splitter housing has at least one input port, at least one output port, a post cartridge, an elastomer clamping element, and a nut. Generally, the post cartridge attaches to the splitter housing through a bore formed in the splitter housing, and the elastomer clamping element and nut are incorporated into a housing. The housing extends outward from the outer surface of the splitter housing to thereby form the outer wall of the connector. A coaxial cable is secured to the connector via the expansion of the elastomer clamping element, wherein the expansion results from the aforementioned nut being driven into the housing.

20 Claims, 7 Drawing Sheets

RF SIGNAL SPLITTER WITH INTEGRATED CONNECTORS

CROSS-REFERENCE TO RELATED APPLICATIONS

This application is a continuation-in-part of U.S. Utility patent application Ser. No. 11/563,421 filed Nov. 27, 2006, which is a continuation of a U.S. Utility patent application Ser. No. 11/074,098 filed Mar. 7, 2005, now U.S. Pat. No. 7,153,160.

TECHNICAL FIELD

The present invention relates to a tap assembly, such as for a CATV system, and in particular to an RF signal splitter having an integrated F-Type connector.

BACKGROUND OF THE INVENTION

Conventional cable broadcasting systems, such as CATV systems that broadcast to a subscriber's terminal device via a drop cable provided from a tap device are known. Generally, tap devices include an incoming port for receiving the RF signal and multiple outgoing ports for providing signals to a plurality of locations. The number of outgoing ports on a tap is generally based upon the number of cable subscribers in the area. For instance, an eight-port tap can be placed geographically near eight homes, even if not all of the homes currently receive cable signals.

Because tap assemblies are commonly located outdoors, they are susceptible to the negative effects of elements, predominantly at the points wherein the drop cables are attached to the tap assembly. Furthermore, because tap assemblies are frequently situated in non-secure locations, they are often targets for individuals seeking to tamper with cable television service.

To reduce theft of service and service calls due to degraded connections outside the home, it is desirable for cable system operators to essentially "hard wire" the drop cable at as many connection points as possible. By directly wiring the drop cable to the tap box, the need for conventional connectors is eliminated, thereby reducing the chances of corrosion due to moisture entry, loosening of contacts due to vibration or insufficient initial tightening. Additionally, directly wiring the drop cable to the tap box serves to decrease the unit's susceptibility to tampering, thereby hindering theft of service.

While some of the aforementioned concerns have been addressed through the use of accessory seals, shields, and specialized wrenches, such devices require additional time and expertise to install. Furthermore, with the advent of addressable taps, the need for insertion of equipment post-install or post-disconnect is essentially eliminated, thereby making removable connections at the tap unnecessary.

In some instances an RF signal splitter is utilized to split the signal received from the tap assembly to multiple locations. The RF signal splitter can split the signal to multiple locations within a building or to multiple distinct buildings. RF signal splitters suffer from the same adverse effects as tap assemblies such as exposure to the elements and theft of service.

Therefore what is needed in the art is an RF signal splitter that provides a connection point that is protected from ill effects of the elements.

Furthermore, what is needed in the art is an RF signal splitter that provides a connection point that is substantially tamper proof.

Furthermore still, what is needed in the art is an RF signal splitter that is not difficult to install and replace.

Additionally, what is needed in the art is an RF signal splitter that will provide a secure connection that will not substantially loosen over time.

SUMMARY OF THE INVENTION

The present invention provides a cable antenna television (CATV) RF signal splitter with at least one integrated F-type connector. The disclosure includes two embodiments. In a first embodiment the housing includes a threaded portion that serves to mate with a threaded nut In a second embodiment the housing includes a bore that receives an internally threaded insert. In addition to the unique housing, both first and second embodiments include, an elastomer clamping element and a threaded nut.

Generally, the present invention serves to provide a cable connection that is secure and weatherproof. This is accomplished by building a substantial portion of the connector directly into the RF signal splitter. The necessary structures for receiving and retaining prepared cable are integral with the RF signal splitter.

The cable shall be prepared in the conventional manner and inserted into an open port on the RF signal splitter. A special compression tool would then be used to engage the movable parts of the assembly, and move them to a cable engaging position.

The first embodiment of the RF signal splitter of the present invention comprises a splitter housing and associated components for forming an integrated F-Type connector. The splitter housing has at least one input port and at least one output port. In addition to the aforementioned splitter housing, the integrated connector assembly includes an elastomer clamping element, a nut, and optionally a post cartridge. Generally, the post cartridge attaches to the RF signal splitter through a bore formed in the splitter housing, and the elastomer clamping element and nut are incorporated into a housing. The housing extends outward from the outer surface of the RF signal splitter to thereby form the outer wall of the connector. A coaxial cable is secured to the connector via the expansion of the elastomer clamping element, wherein the expansion results from the aforementioned nut being driven into the housing.

As in the previous embodiment, the second embodiment also includes a splitter housing having at least one input port and at least one output port. Also, as in the previous embodiment, the integrated connector assembly includes an elastomer clamping element, a nut, and optionally a post cartridge. However, in addition to the aforementioned elements, this particular embodiment further comprises a press-fit compression-movable threaded insert. In operation, the post cartridge is attached to the splitter housing through a bore formed in the cylindrical housing. The elastomer clamping element, nut, and threaded insert are incorporated within the cylindrical housing. As above, the cylindrical housing extends outward from the outer surface of the splitter housing to thereby form the outer wall of the connector. The coaxial cable is secured or "hard wired" to the connector assembly via the expansion of the elastomer clamping element resulting from the nut being driven into threaded insert residing in the housing. However, the connector is further secured to the splitter housing by driving the threaded insert into the housing until it bottoms upon the base.

An advantage of the present invention is that a cable can be secured directly to a signal splitter, thereby providing a connection point that is protected from the elements.

Another advantage of the present invention is that it provides a RF signal splitter with a connection point that is substantially tamper proof.

A further advantage of the present invention is that it provides a RF signal splitter that is relatively easy for an operator to install and replace.

BRIEF DESCRIPTION OF THE DRAWINGS

The above-mentioned and other features and advantages of this invention, and the manner of attaining them, will become apparent and be more completely understood by reference to the following description of one embodiment of the invention when read in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
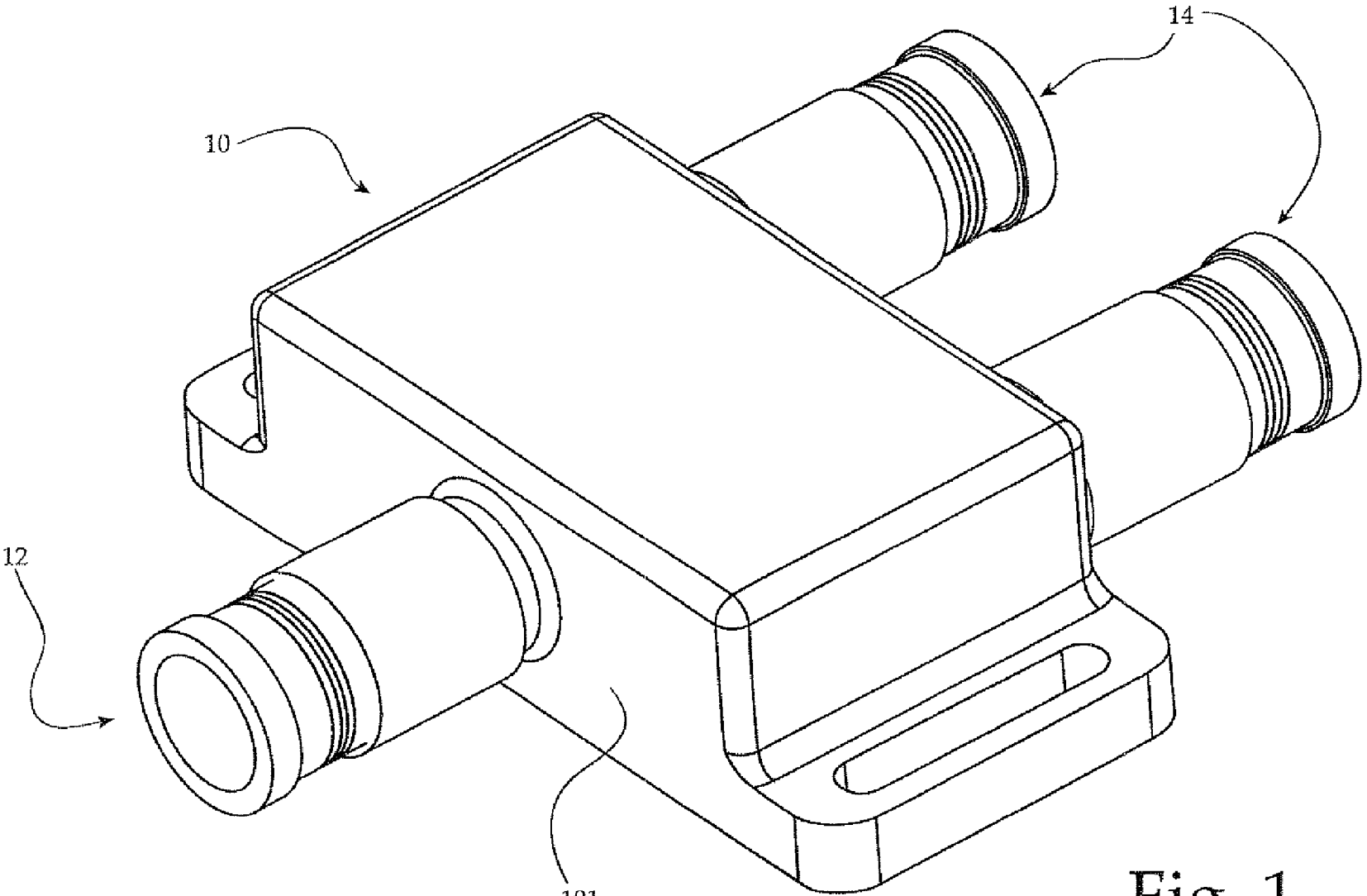
FIG. 1 is a perspective view illustrating an RF signal splitter with one input port and 2 output ports.

Reference will now be made in detail to the specific embodiments of the invention, examples of which are illustrated in the accompanying drawings. Wherever possible, the same reference numbers will be used throughout the drawings to refer to the same or like parts. Referring to the drawings, and particularly to FIG. 1, there is shown an RF signal splitter 10, wherein an input port 12 and two output ports 14 are extending outward from the splitter housing 101. An RF signal sent into the input port 12 can be split into multiple, equal or distinct, output signals through the output ports 14. The RF signal splitter 10 can either be passive or contain an additional input for a power source (not show) to amplify the signal.

Figure 2:
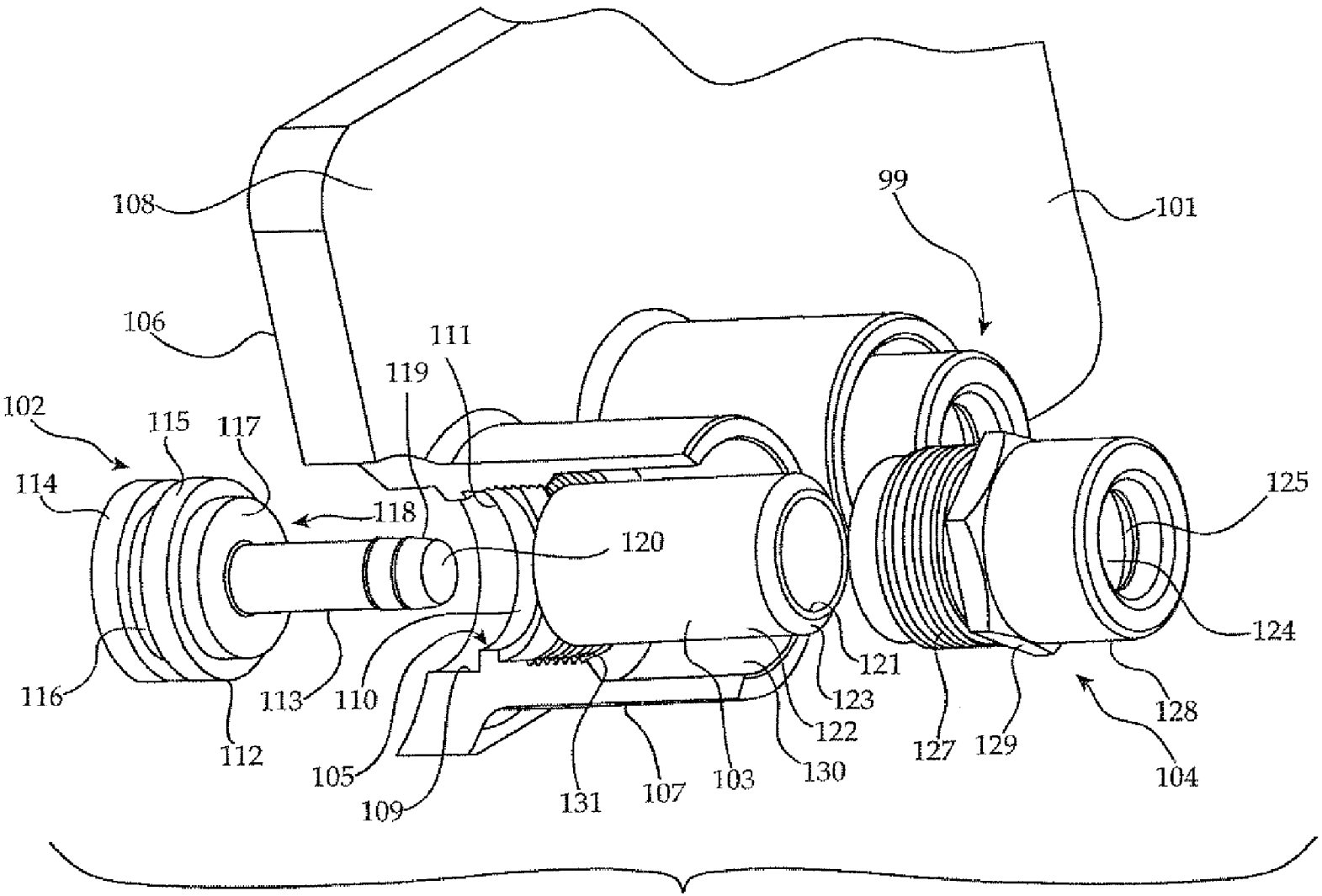
FIG. 2 is an exploded view illustrating elements of the RF signal splitter, according to a first embodiment of the present invention.
Figure 3:
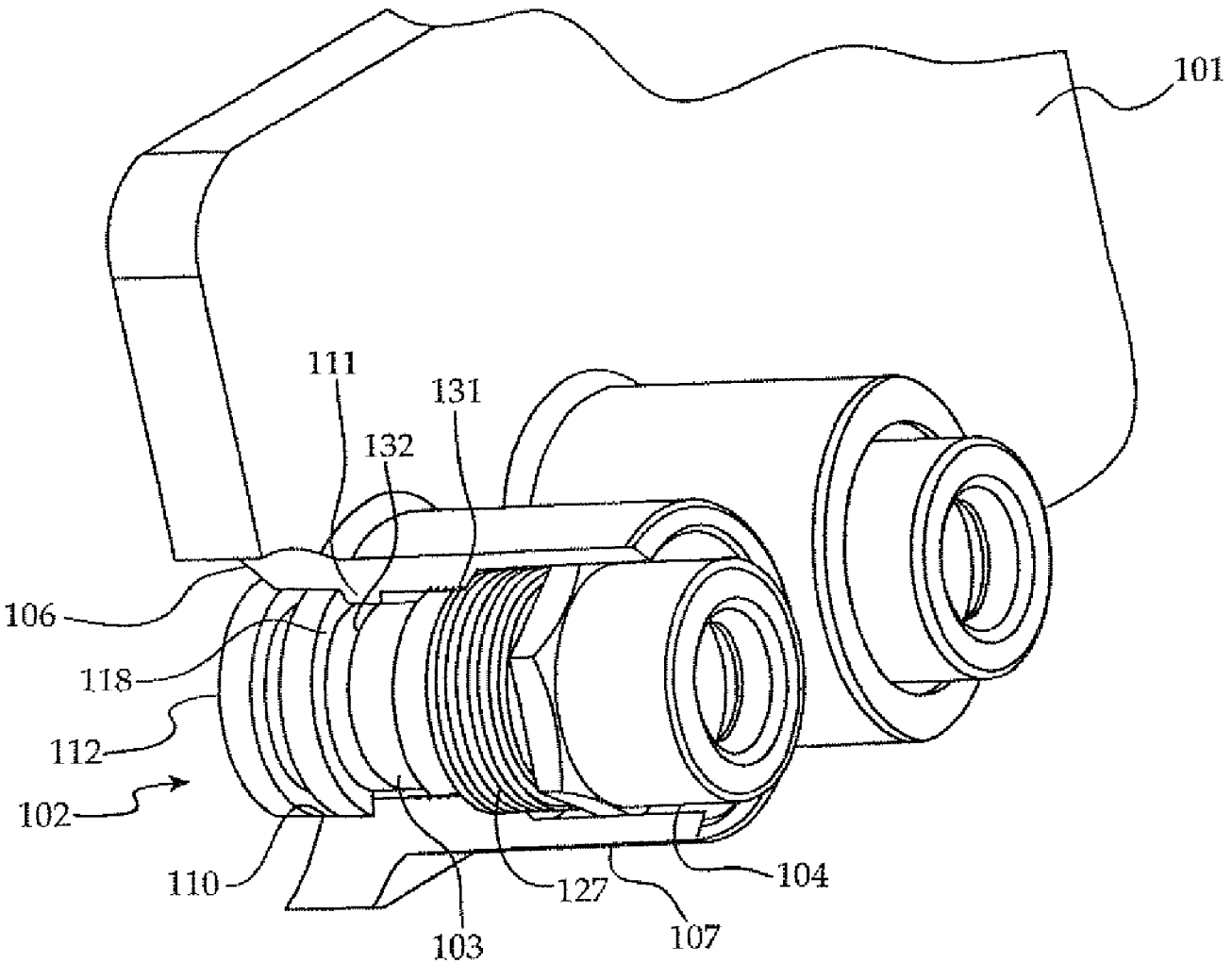
FIG. 3 is a perspective view of a partially assembled RF signal splitter with portions broken away, according to a first embodiment of the present invention.
Figure 4:
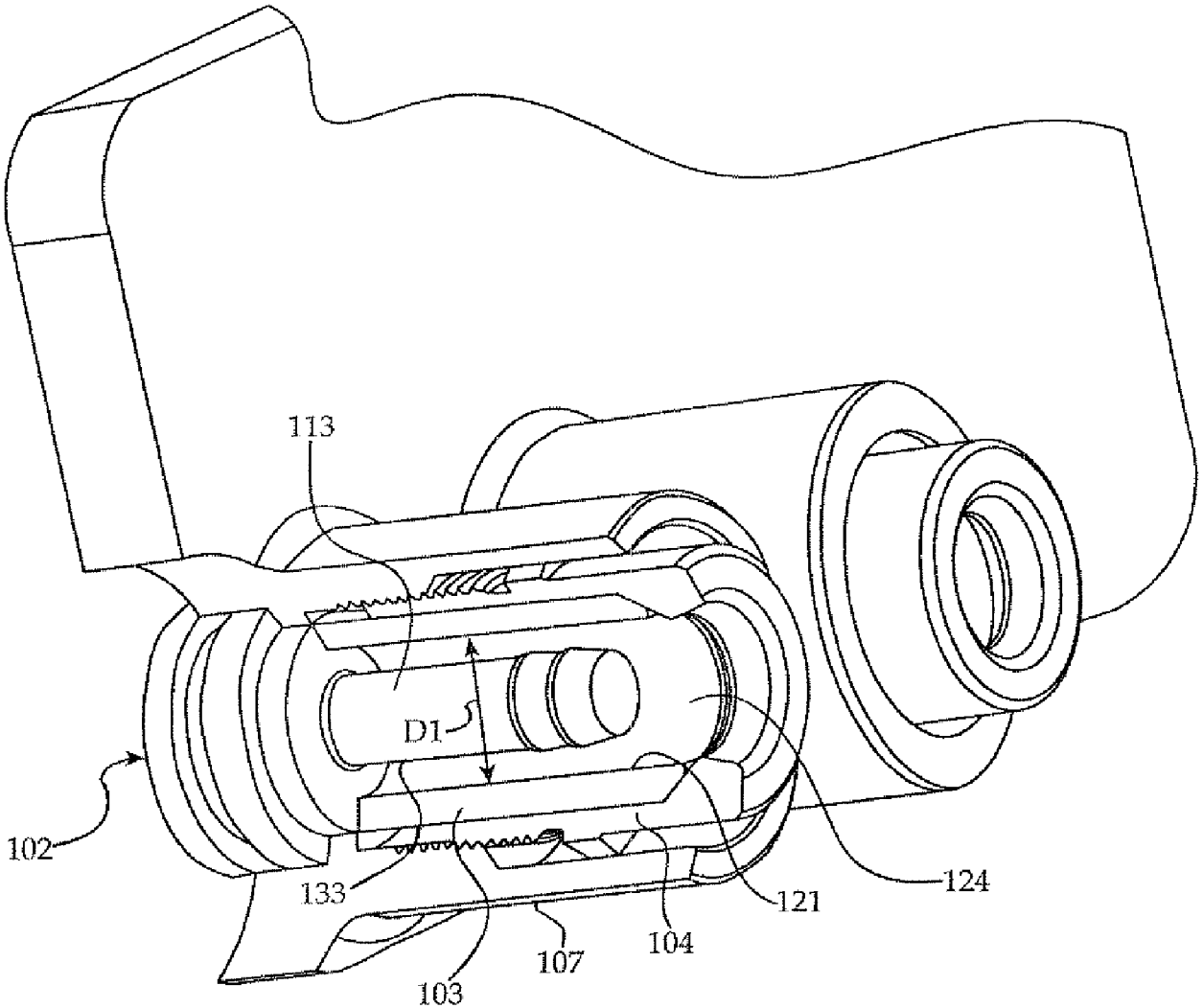
FIG. 4 is a perspective view of a partially assembled RF signal splitter with portions broken away, according to a first embodiment of the present invention.

Referring now to FIGS. 2-4, there is shown a first embodiment of the RF signal splitter of the present invention. Referring particularly to FIG. 2, a portion of the RF signal splitter of the present invention is shown. A splitter housing 101 and associated components for forming an integrated F-Type connector are shown. The splitter housing 101 has at least two ports 99, a post cartridge 102, an elastomer clamping element 103, and a nut 104. Generally, the post cartridge 102 attaches to the splitter housing 101 through a bore 105 formed in the inner surface 106 of the splitter housing 101, and the elastomer clamping element 103 and nut 104 are incorporated into a cylindrical housing 107 extending outward from the outer surface 108 of the splitter housing 101 to thereby form the connector.

The splitter housing 101 comprises at least one port 99 having a cylindrical housing 107, integral with, and extending outward from the outer surface 108 of splitter housing 101. The port 99 further comprises a bore 105 in the splitter housing 101, having substantially circular bore segment 109 of a first diameter, adjacent to a second circular bore segment 110 having a second diameter which is smaller than the diameter of the first bore 109. The aforementioned bore segments 109 and 110 cooperate to form an annular lip 111 in the faceplate. As will be better understood from the following description, the lip 111 formed in the splitter housing 101 is adapted to receive the base segment 112 of the post cartridge 102. Additionally, the opposing side of the lip 111 shall serve as a stop for the nut 104, as will be described in greater detail.

The post cartridge 102 comprises a base 112 and a stem 113. The base 112 of the post cartridge 102 comprises a pair of substantially cylindrical protruding segments 114 and 115 respectively, separated by an annular groove 116. As will be explained in greater detail, the annular groove 116 in the base 112 serves to provide a means for attaching the post cartridge 102 to the splitter housing 101. Additionally, the base portion 112 of the post cartridge 102 terminates at a coaxial cylindrical disk 117, wherein said cylindrical disk 117 has a diameter less than the diameter of the adjacent cylindrical protruding segment 115. The disk segment 117 and the adjacent protruding segment 115 cooperate to form a flanged portion 118 on the base 112. The flanged portion 118 of the base 112 is adapted to be received within the bore 105 and lip 111 on the inner surface 106 of the splitter housing 101. The post cartridge 102 further comprises a stem 113. The stem 113 is generally an elongated coaxial shell extending from said base segment 112, and terminating with a frusto-conical lip 119. Additionally, the stem 113 and base 112 of the post cartridge 102 includes a bore 120 for receiving the inner portion of a coaxial cable (not shown).

The connector assembly further includes a cylindrical elastomer clamping element 103. The elastomer clamping element 103 is produced of a suitable elastomeric material which is deformable under sufficient applied pressure. The elastomer clamping element 103 has an inner bore 121 having a consistent diameter throughout its axial length. The outer surface 122 is substantially cylindrical throughout most of its length, with the remainder generally tapering to a smaller diameter at its end, thereby defining a tapered end segment 123. The tapered end segment 123 of the elastomer clamping element 103 is adapted to be received by an internal tapered groove 125 formed in the cylindrical bore 124 within the nut 104.

A portion of the outer surface 126 of the nut 104 is externally threaded 127. More particularly, the outer surface of the nut 104 includes a threaded segment 127 on a first end and a cylindrical segment 128 on an opposing end, wherein said first end and said opposing end of the nut 104 are separated by a hexagonal gripping means 129. The hexagonal gripping means 129 serves to facilitate driving the nut 104 toward or away from the splitter housing 101. To further deter tampering with the connection, a specialized tool (not shown) is adapted to fit within the cylindrical housing 107, and communicate with the gripping means 129 of the nut 104. Additionally, the nut 104 further has an internal bore 124 having a constant diameter throughout the majority of its axial length, with the remainder generally tapering to a smaller diameter at its end, thereby defining a tapered groove 125. As discussed above the tapered groove 125 of bore 124 is adapted to receive the tapered end segment 123 of the elastomer clamping element 103.

Referring once again to the splitter housing 101, a cylindrical housing 107 extending from the outer surface 108 of the splitter housing 101 further comprises an inner bore 130. The inner bore 105 of the housing 107 communicates with the aforementioned bore 130 in the splitter housing 101. The bore 130 formed in the housing 107 includes a threaded segment 131 configured to receive the threaded portion 127 of the nut 104.

Referring now to FIGS. 3 and 4, perspective views of a partially assembled device according to the present invention with portions broken away are shown. FIG. 3 illustrates the flanged end 118 of the base 112 of the post cartridge 102, in communication with the cylindrical bore 110 and lip 111 on the inner surface 106 of the splitter housing 101. In this partially assembled configuration, the threaded segment 127 of the nut 104 is secured a few turns into the threaded segment 131 of the housing 107. As further illustrated in the figure, the lower rim 132 of the elastomer coupling element 103 is in communication with the base 112 of the post cartridge 102. Referring to FIG. 4, the elastomer clamping element 103 is within the bore 124 formed in the nut 104, the diameter of the bore 121 formed in the elastomer clamping element 103 is referenced as D1. In this partially assembled configuration, the elastomer clamping element 103 is in an uncompressed state, wherein the area between the outer surface 133 of the stem 113 and the bore 121 formed in the elastomer clamping element 103 is sufficient to loosely receive the portion of the coaxial cable (not shown), generally enclosed in that area.

Figure 5:
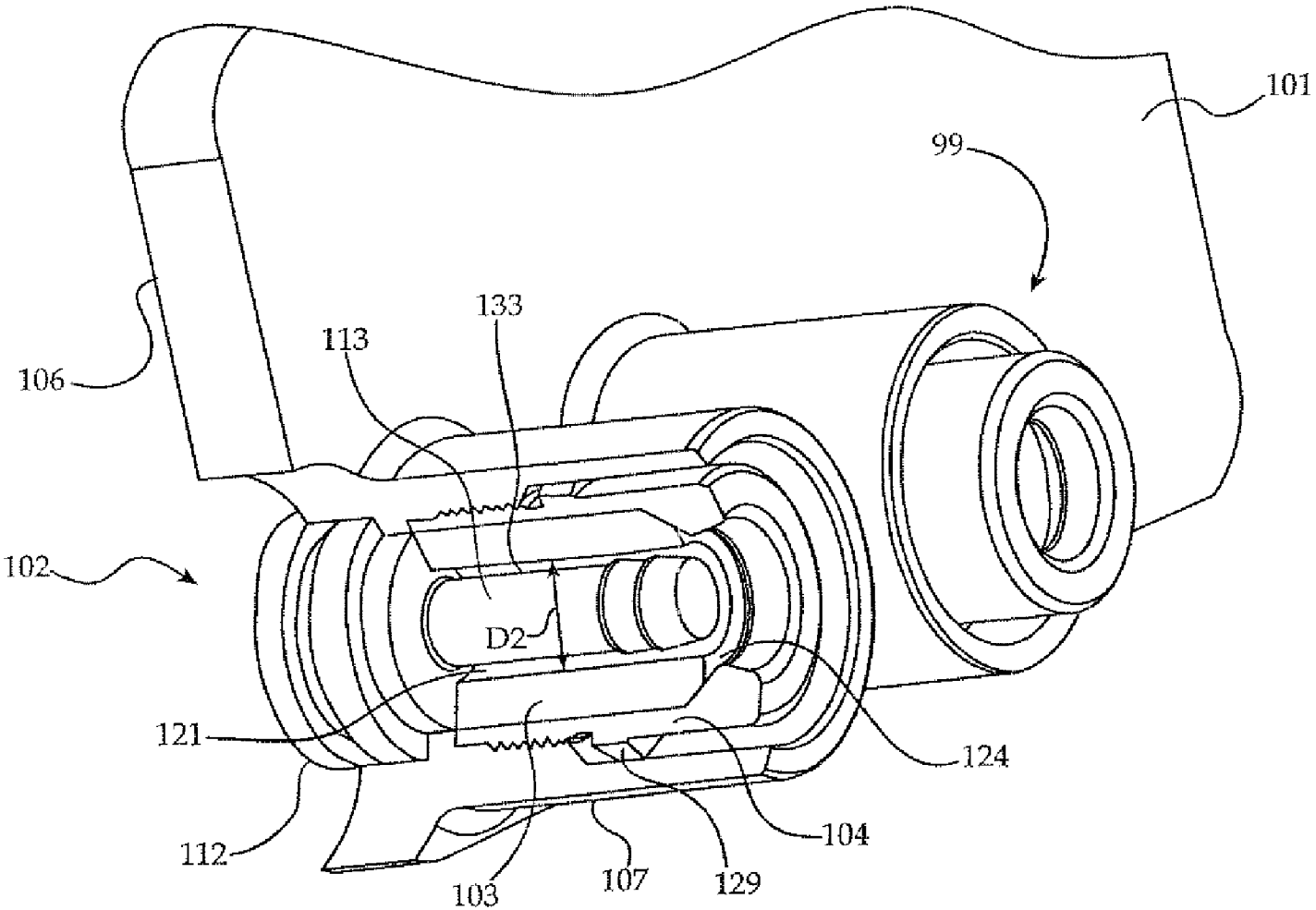
FIG. 5 is a perspective view of a fully assembled RF signal splitter with portions broken away, according to a first embodiment of the present invention.

In contrast to the partially assembled configuration of FIG. 4, FIG. 5 provides a view of the assembled device, wherein the nut 104 is completely seated within the cylindrical housing 107. While a fully assembled connector shall generally include a coaxial cable, it has been omitted in the Figures and description thus far, so as not to obscure the interaction between the aforementioned elements of the invention. Referring once again to FIG. 5, advancing the nut 104 into the housing 107, toward the base 112, and fully seating the nut 104 within the housing 107, serves to compress the elastomer clamping element 103. With the elastomer clamping element 103 compressed within the bore 124 formed in the nut 104, the diameter of the bore 121 formed in the elastomer clamping element 103 referenced as D2 is now smaller than the diameter of the uncompressed state D1 (FIG. 4). The resulting change in diameter serves to reduce the area between the outer surface 133 of the stem 113 and the surface of the bore 121 formed in the elastomer clamping element 103. In operation, this reduction in area is sufficient to fixedly attach the coaxial cable (not shown) within the housing 107 to the post cartridge 102. Furthermore, the elastomer clamping element 103 and the outer surface of the coaxial cable (not shown) serve to provide a sealing means, thereby protecting the connector from the elements.

In the event that the coaxial cable and assembled connector need to be removed from the tap assembly, a specialized tool adapted to fit within the cylindrical housing 107 and communicate with the gripping means 129 shall be required to remove the nut 104 from the cylindrical housing 107. With the nut 104 removed, the elastomer clamping element 103 is no longer in the compressed state, allowing for the coaxial cable to be removed from the post cartridge 102. Additionally, the coaxial cable and assembled connector may be removed from the port 99 by opening the splitter housing 101 and detaching the post cartridge 102 from the inner surface 106 of the splitter housing 101. Generally, a retainer clip (not shown) shall serve as a means for attaching the post cartridge 102 to the splitter housing 101. With the post cartridge 102 detached from the splitter housing 101, the nut 104 should be disengaged from the cylindrical housing 107. The coaxial cable may now be cut thereby allowing the post cartridge 102, elastomer clamping element 103, and portion of remaining coaxial cable attached thereto, to be pulled through the port 99 and discarded as required. A replacement cable may then be attached as described above.

Figure 6:
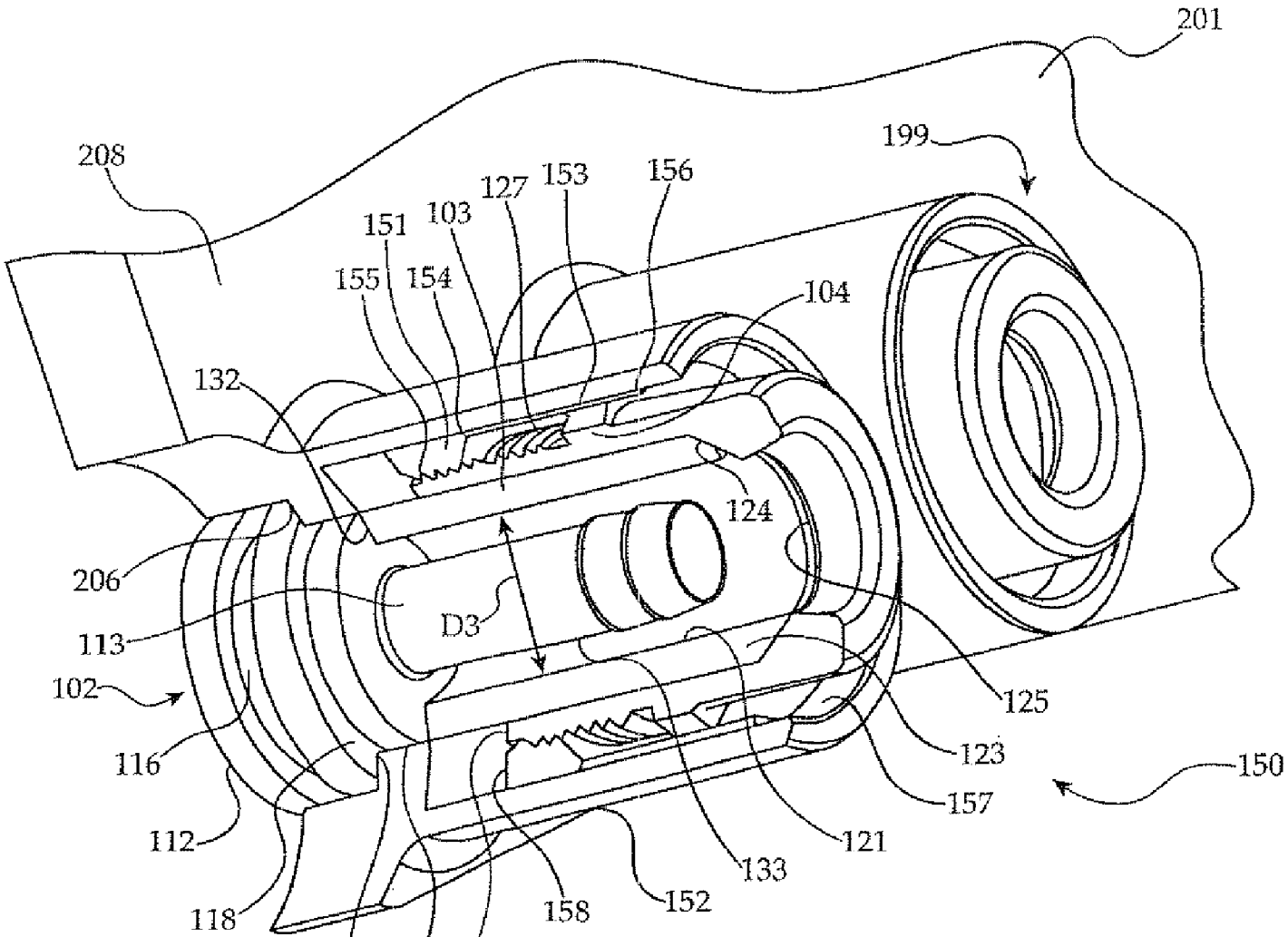
FIG. 6 is a perspective view of a partially assembled RF signal splitter with portions broken away, according to a second embodiment of the present invention.
Figure 7:
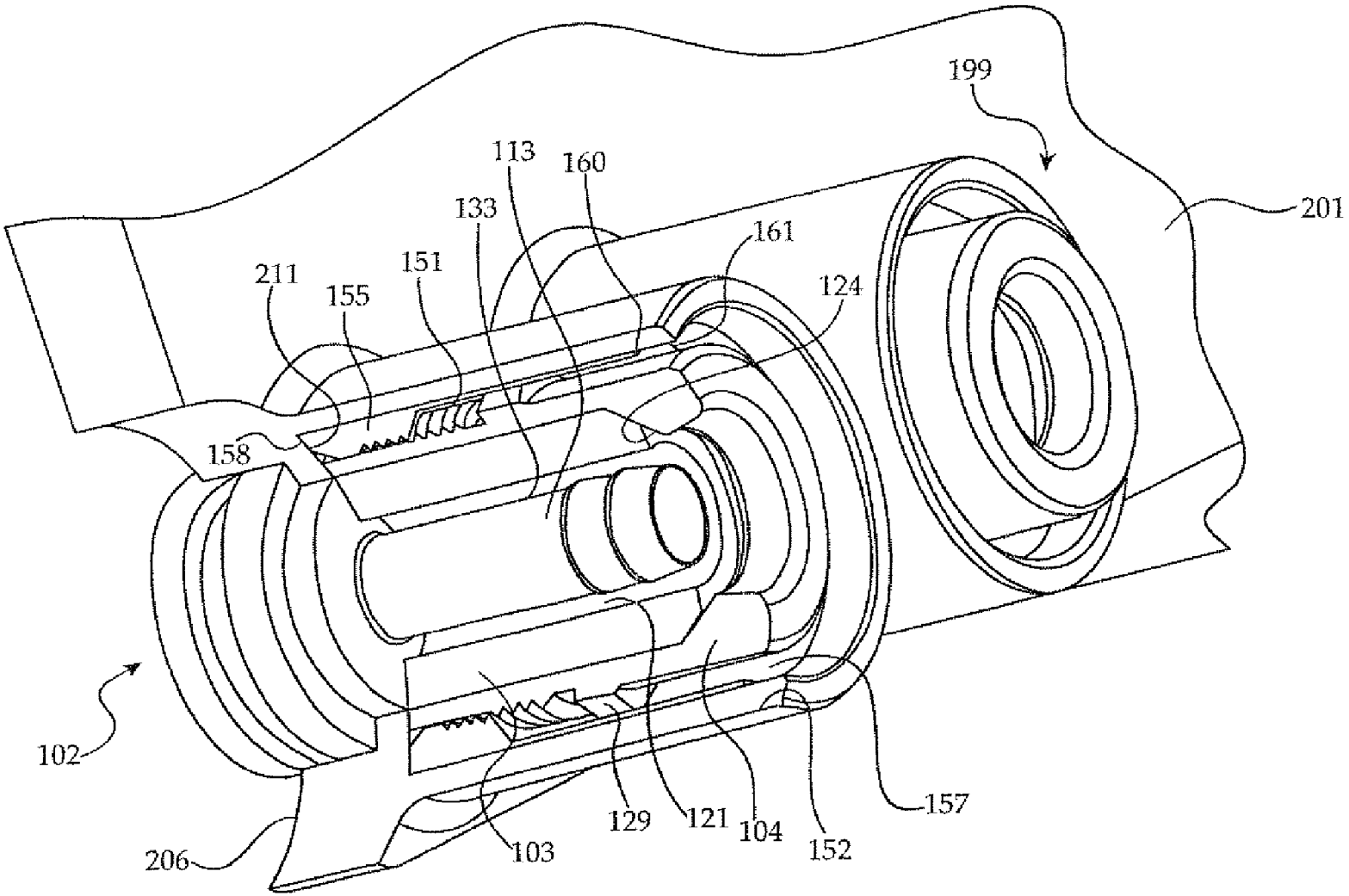
FIG. 7 is a perspective view of a fully assembled RF signal splitter with portions broken away, according to a second embodiment of the present invention.

Referring now to FIGS. 6-8 an additional embodiment of the present invention 150 is shown. The figures illustrate perspective views of this particular embodiment 150 of the present invention with portions broken away. As in the previous embodiment, the RF signal splitter includes a splitter housing 201 having at least one port 199. Also, as in the previous embodiment, the integrated connector assembly includes a post cartridge 102, an elastomer clamping element 103, and a nut 104. In addition to the aforementioned elements, this particular embodiment includes a press-fit compression-movable threaded insert 151. Generally, the post cartridge 102 is attached to the splitter housing 201 through a bore 205 formed in the inner surface 206 of the splitter housing 201, and the elastomer clamping element 103, the nut 104, and the threaded insert 151 are incorporated within the cylindrical housing 152 extending outward from the outer surface 208 of the splitter housing 201 to thereby form the connector.

As in the previous embodiment, the splitter housing 201 comprises at least one port 199 having a cylindrical housing 152, integral with, and extending outward from the outer surface 208 of splitter housing 201. The port 199 further comprises an annular lip 211 formed in the splitter housing 201. As will be better understood from the following description, the lip 211 formed splitter housing 201 is adapted to receive the base segment 112 of the post cartridge 102. Additionally, the opposing side of the lip 211 segment shall serve as a stop for the threaded insert 151 and nut 104, as will be described in greater detail.

The post cartridge 102 of the present embodiment 150 is substantially the same as the post cartridge utilized in the previous embodiment. An annular groove 116 in the base 112 serves to provide a means for removably attaching the post cartridge 102 to the faceplate 201, and a flanged portion 118 of the base 112 is adapted to be received within the bore 205 and lip 211 on the inner surface 206 of the splitter housing 201. Furthermore, the elastomer clamping element 103 having the tapered end segment 123, and threaded nut 104 containing a bore 124 having a tapered groove 125 are also included in this assembly. In addition to the aforementioned components, the assembly further comprises a press-fit compression-movable threaded insert 151. The threaded insert 151 comprises a cylindrical outer surface 153 and an inner bore 154. The inner bore 154 of the threaded insert 151 comprises a threaded segment 155 and a cylindrical segment 156, wherein the threaded segment 155 is adapted to receive the threaded segment 127 of the externally threaded nut 104.

In contrast to the cylindrical housing 152 extending from the splitter housing 201 of the previous embodiment, the bore 157 of the cylindrical housing 152 of this particular embodiment 150 has a consistent diameter throughout its axial length. Furthermore, the bore 157 is adapted to receive the threaded insert 151 (as illustrated in FIGS. 6-7).

Referring once again to FIG. 6 the connector assembly of the present invention is configured to be assembled within the cylindrical housing 152. In the pre-assembled position as shown, the nut 104 and the threaded insert 151 are not in the fully seated position, and the elastomer clamping element 103 is uncompressed. More particularly, the lower rim 158 of the threaded insert 151, contained within the cylindrical housing 152, is positioned a distance from the lip 211 on the splitter housing 201. Additionally, the threaded segment 127 of the nut 104 is secured a few turns into the threaded segment 155 of the threaded insert 151, and the lower rim 159 of the nut 104 is positioned substantially the same distance from the lip 211 as the lower rim 158 of the threaded insert 151. The figure further illustrates the lower rim 132 of the elastomer coupling element 103 in communication with the base segment 112 of the post cartridge 102.

While FIG. 6 provides a view of a partially assembled connector, FIG. 7 illustrates the device of the present invention wherein the nut 104 is fully seated within the cylindrical housing 152. While a fully assembled connector shall generally include a coaxial cable (not shown), it has been omitted in the Figures and description thus far, so as not to obscure the interaction between the aforementioned elements of the invention. As illustrated in FIG. 6, the diameter of the bore 121 of the elastomer clamping element 103 is referenced as D3. In this partially assembled configuration, the elastomer clamping element 103 is in an uncompressed state, wherein the area between the outer surface 133 of the stem 113 segment and the bore 121 formed in the elastomer clamping element 103 is sufficient to loosely receive the portion of the coaxial cable (not shown), generally enclosed in that area. Referring once again to FIG. 7, advancing the nut 104 into the threaded insert 151, and fully seating the nut 104 serves to compress the elastomer clamping element 103. With the elastomer clamping element 103 compressed within the bore 124 formed in the nut 104, the diameter of the bore 121 formed in the elastomer clamping 103 element 104 is now smaller than the diameter of the uncompressed state 103 (FIG. 6). The resulting change in diameter serves to reduce the area between the outer surface 133 of the stem 113 and the surface of the bore 121 formed in the elastomer clamping element 103. In operation, this reduction in area is sufficient to crimp, or fixedly attach the coaxial cable within the housing 152 to the post cartridge 102. Furthermore, in this configuration the elastomer clamping element 103 and the outer surface of the coaxial cable (not shown) serve to provide a sealing means, thereby protecting the connector from the elements.

The threaded insert 151 further comprises an upper rim 160 which is accessible via a special compression tool, through the top opening 161 in the cylindrical housing 152. The insert 151 is moved into the compressed position by advancing the threaded portion 155 of the insert 151 until the lower rim 158 of the threaded insert 151 is in abutting engagement lip 211 portion of the splitter housing 201. With the nut 104 and threaded insert 151 in the compressed position the connector assembly is now securely affixed to the splitter housing 201.

In the event that the coaxial cable needs to be replaced, the operator utilizes the aforementioned special compression tool, adapted to fit within the cylindrical housing 152 and communicate with the upper rim 160 of the threaded insert 151 Additionally, the specialized tool needed to access the gripping means 129 of the nut 104 is also required. Upon removal of the nut 104 and threaded insert 151 removed, the elastomer clamping element 103 is no longer in the compressed state, thereby allowing the coaxial cable (not shown) to be removed from the post cartridge 102. Additionally, the coaxial cable may be removed from the port 199 by opening the splitter housing 201 and detaching the post cartridge 102 from the inner surface 206 of the splitter housing 201. Generally, a retainer clip (not shown) shall serve as a means for attaching the post cartridge 102 to the splitter housing 201. With the post cartridge 102 detached from the splitter housing 201, and the threaded insert 151 and the nut 104 disengaged from the cylindrical housing 152, the coaxial cable may be cut, thereby allowing the post cartridge 102, elastomer clamping element 103, and portion of remaining coaxial cable attached thereto to be pulled through the port 199 and discarded as required. A replacement cable may then be attached as described above.

While this invention has been described as having particular embodiments, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed is:

1. An RF signal splitter comprising:

a splitter housing comprising a plurality of ports including at least;

an incoming port; and at least two outgoing port;

wherein at least one of said incoming or outgoing ports has an integral housing with a bore adapted to receive a threaded nut and an elastomeric clamping means;

wherein said elastomeric clamping means comprises a substantially cylindrical elastomer element having a bore throughout its axial length, and is adapted to be received within a bore formed in said threaded nut comprising a tapered groove;

wherein said elastomeric clamping means further comprises a tapered end segment wherein said tapered groove of said bore formed within said threaded nut is adapted to receive said tapered end segment.

2. The RF signal splitter of claim 1 wherein said bore adapted to receive a threaded nut further comprises a threaded segment adapted to receive said threaded nut and said elastomeric clamping means.

3. The RF signal splitter of claim 1 wherein said plurality of ports comprises one incoming port and two outgoing ports.

4. The RF signal splitter of claim 1 further comprising an amplifying circuit connected said incoming port and said outgoing port such that output signals are stronger than input signals.

5. The RF signal splitter of claim 1 further comprising a post cartridge having a stem proximate to said elastomeric clamping means, and advancing said threaded nut into said integral housing serves to deform said elastomeric clamping means and cause a reduction in the distance between said stem and said elastomeric clamping means.

6. The RF signal splitter of claim 1 wherein said bore adapted to receive a threaded nut further comprises a consistent diameter throughout its axial length adapted to receive an internally threaded insert, said threaded nut and said elastomeric clamping means.

7. The RF signal splitter of claim 6 wherein advancing the insert into the housing, until said insert is in abutting engagement with a lip portion formed in said splitter housing, serves to secure said insert and said threaded nut to said splitter housing.

8. An RF signal splitter comprising:

a) a plurality of ports attached to a splitter housing, wherein at least one of said ports is an incoming port and at least one of said ports is an outgoing port; wherein at least one of said ports has an integral housing comprising a bore adapted to receive a threaded nut and an elastomeric clamping means;

b) a post cartridge having a stem proximate to said elastomeric clamping means, and advancing said threaded nut into said integral housing serves to deform the elastomeric clamping means and cause a reduction in the distance between said stem and said elastomeric clamping means.

9. The RF signal splitter of claim 8 wherein said bore adapted to receive a threaded nut further comprises a threaded segment adapted to receive said threaded nut and said elastomeric clamping means.

10. The RF signal splitter of claim 8 wherein said reduction in the distance between said stem and said elastomeric clamping means is sufficient to fixedly attach a coaxial cable to said post cartridge.

11. The RF signal splitter of claim 8 further comprising a means for removably attaching said post cartridge to said splitter housing.

12. The RF signal splitter of claim 8 further comprising:

a) an annular groove formed on a base segment of said post cartridge;

b) a groove formed on the inner surface of said splitter housing;

c) a retainer clip, wherein said retainer is adapted to engage said annular groove formed on said base segment of said post cartridge and said groove formed on the inner surface of said splitter housing to thereby secure said post cartridge to said splitter housing.

13. The RF signal splitter of claim 8 further comprising an amplifying circuit connected between said incoming port and at least one outgoing port such that output signals have a greater strength than input signals.

14. The RF signal splitter of claim 8 wherein said plurality of ports comprises one incoming port and two outgoing ports.

15. The RF signal splitter of claim 8 wherein said bore adapted to receive a threaded nut further comprises a consistent diameter throughout its axial length adapted to receive an internally threaded insert, said threaded nut and said elastomeric clamping means.

16. The RF signal splitter of claim 15 wherein advancing the insert into the housing, until said insert is in abutting engagement with a lip portion formed in said splitter housing, serves to secure said insert and said threaded nut to said splitter housing.

17. An RF signal splitter comprising:

a splitter housing comprising at least one incoming port and at least two outgoing ports;

wherein at least one of said incoming or outgoing ports has an integral housing with a bore adapted to receive a threaded nut, a post cartridge and an elastomeric clamping means;

wherein said elastomeric clamping means comprises an elastomer element having a bore throughout its axial length positioned between said threaded nut and said post cartridge, wherein advancing said threaded nut into said integral housing serves to deform the elastomeric clamping means by reducing the diameter of said bore throughout the axial length.

18. The RF signal splitter of claim 17 wherein said bore adapted to receive a threaded nut further comprises a threaded segment adapted to receive said threaded nut and said elastomeric clamping means.

19. The RF signal splitter of claim 17 wherein the reduction in the diameter of said bore throughout the axial length is sufficient to fixedly attach a coaxial cable to said post cartridge.

20. The RF signal splitter of claim 19 wherein said coaxial cable is an insulated coaxial cable.

* * * * *